United States Patent [19]

Dagenais

[11] Patent Number: 4,660,613

[45] Date of Patent: Apr. 28, 1987

[54] FOLDING CLOSURE ASSEMBLY

[76] Inventor: Robert Dagenais, 86 Grandcote, St-Eustache, Quebec, Canada, J7P 1A6

[21] Appl. No.: 813,634

[22] Filed: Dec. 26, 1985

[51] Int. Cl.[4] ..... E05D 3/00

[52] U.S. Cl. ..... 160/199; 160/183

[58] Field of Search ..... 160/199, 183, 235, 206, 160/229, 345

[56] References Cited

U.S. PATENT DOCUMENTS

| | | | |
|---|---|---|---|
| Re. 29,308 | 7/1977 | Dagenais | 160/183 |
| 878,876 | 2/1908 | Fox . | |
| 1,963,273 | 6/1934 | Kellogg | 16/163 |
| 3,053,318 | 9/1962 | Artman | 160/183 X |
| 3,267,990 | 8/1966 | Harris | 160/199 |
| 3,359,594 | 12/1967 | Pastoor | 16/178 |
| 3,419,063 | 12/1968 | Mock et al. | 160/199 |
| 4,081,881 | 4/1978 | Lamarre | 16/162 |
| 4,228,841 | 10/1980 | Dixon | 160/183 |
| 4,380,260 | 4/1983 | Labelle | 160/235 |
| 4,386,645 | 6/1983 | Dever et al. | 160/183 |
| 4,434,525 | 3/1984 | Labelle | 16/355 |
| 4,497,357 | 2/1985 | Labelle | 160/199 |

FOREIGN PATENT DOCUMENTS 621855 6/1961 Canada .

766561 9/1967 Canada .

*Primary Examiner*—Robert W. Gibson, Jr.

*Attorney, Agent, or Firm*—Shlesinger, Arkwright, Garvey & Fado

[57] ABSTRACT

A folding closure assembly has fewer components than existing designs and provides hinges which do not have to extend for the full height of the assembly and thus require less opening and closing force. The assembly comprises adjacent panels joined by a one piece vertical hinge member, and top roller supports positioned at the center of every second panel for supporting the foldable closure assembly in a top support track, the one piece vertical hinge member extending from top to bottom of the panels and having a cross section with two semi-circular grooves with a single opening for each groove, the opening for each groove being on opposing sides of the hinge member, each of the semi-circular grooves in the hinge member having a vertical axial aperture for locking screw at top and bottom of hinge member, the panels having portions positioned at least at top and bottom of each of the panels, the strips with curved vertical sides to rotate in the semi-circular grooves through the openings, the curved vertical sides having stops to restrict rotation of each panel in the semi-circular grooves to about 90°.

6 Claims, 4 Drawing Figures

FOLDING CLOSURE ASSEMBLY

The present invention relates to a folding closure or door having a series of vertical strip panels vertically hinged together and supported by rollers running in a top track.

Folding closure assemblies for closing and opening are well known. The folding assemblies may be solid panels, or alternatively, may be an open grill design. Such assemblies are used across store fronts in shopping malls and the like. When the closure is closed to fill the opening, the panels are substantially in line and flat, and when the closure is open, the panels are accordioned together and in some cases may fit into a compartment at one side of the opening. The use of the term "panels" throughout the specification refers to panels made of solid or one piece sheets, transparent sheets with supporting strips, or grills with apertures between supporting strips.

Folding closure assemblies are generally supported by rollers running in a track extending across the top of the opening. A bottom track is not generally used as it is preferred to have a smooth floor without obstructions in the opening, particularly for shopping malls.

There are many different designs of folding closure assemblies for store fronts and the like. Most of these designs are lightweight, generally made from aluminum, but strong enough to prevent access. Some have clear panels of glass or plastic therein, others are grill like which reduces the weight still further. Most of the designs have vertical hinges at the edges of each panel extending from the top to the bottom. The full length hinge tends to require some force to open and close due to friction, and the force to open one hinge must be multipled by the number of hinges in the closure. Thus the overall force to open and close the assembly can be more than one individual can apply. Another disadvantage with some existing designs of folding closures is that they have many different components which increases the cost, makes the design complicated and the assembly heavy.

It is an aim of the present invention to provide a folding closure assembly which has a novel design requiring fewer components and providing a hinge which does not have to extend for the full height of the assembly.

The present invention provides a foldable closure assembly comprising: a plurality of panels with adjacent panels joined by a one piece vertical hinge member, and top roller supports positioned at the center of every second panel for supporting the foldable closure assembly in a top support track, the one piece vertical hinge member extending from top to bottom of the panels and having a cross section with two semi-circular grooves with a single opening for each groove, the opening for each groove being on opposing sides of the hinge member, each of the semi-circular grooves having a vertical axial at top and bottom for locking means, the panels having portions, positioned at least at top and bottom of each of the panels, with curved vertical sides to rotate in the semi-circular grooves of the hinge member through the openings, the curved vertical sides having stops to restrict rotation of each panel in the semi-circular grooves of the hinge member to about 90°.

In other embodiments of the invention the portions in each of the semi-circular grooves are joined together to form a one piece sheet with curved vertical sides extending from top to bottom of the panel, furthermore the locking means at the top and bottom of the hinge member may be a self tapping screw and integral washer fitting into each vertical axial aperture of the semi-circular grooves preventing the curved vertical sides of the panels from sliding out of the semi-circular grooves. In another embodiment at least one panel comprises a plurality of horizontal metal strips with curved vertical sides to rotate in the semi-circular grooves of the hinge member through the openings, and transparent sheets between the horizontal metal strips with top and bottom plastic holders to hold the transparent sheets to the horizontal metal strips, and side plastic holders to hold the transparent sheets, the side plastic holders having curved extension members to fit in the openings of the semi-circular grooves of the hinge member and allow rotation of the side plastic holders in the semi-circular grooves. In yet a further embodiment, the side plastic holders on one side of the panel may be rotated in the semi-circular grooves away from the transparent sheets so the transparent sheets may be removed.

In a still further embodiment at least one panel of the foldable closure assembly comprises a plurality of horizontal metal strips with curved vertical sides to rotate in the semi-circular grooves of the hinge member through the openings, and vertical spacer tubes positioned in the center of the panel between the horizontal metal strips to form an open grill.

In drawings which illustrate embodiments of the invention,

Figure 1:
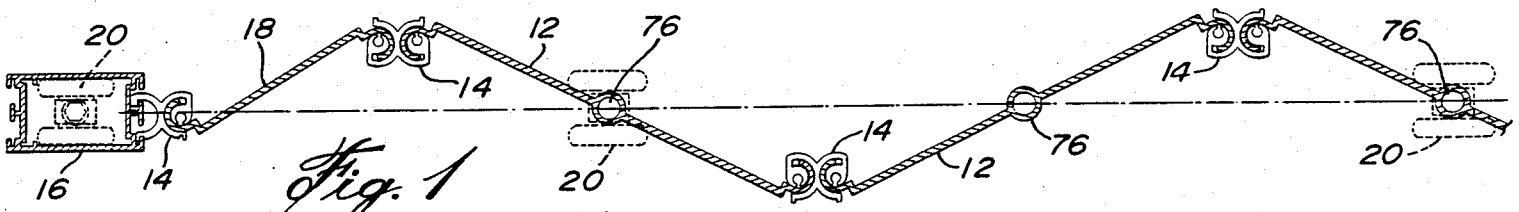
FIG. 1 is a top plan view showing one embodiment of a folding closure assembly in the partly open position according to the present invention.
Figure 2:
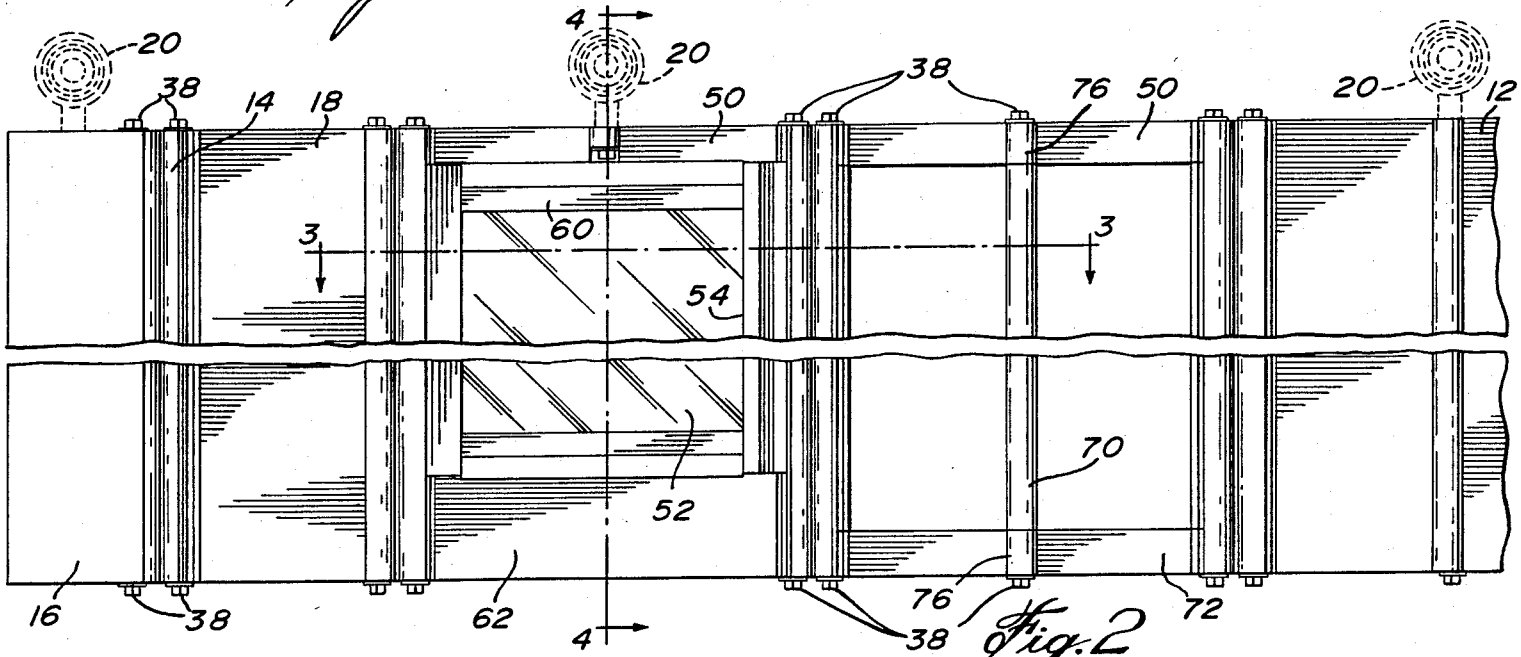
FIG. 2 is a side elevational view showing the folding closure assembly of FIG. 1.

Referring now to the drawings, a foldable closure assembly 10 is shown having panels 12 which join to hinge members 14 allowing panels 12 to have hinges at the vertical sides so they may be folded upon themselves in accordian like fashion. As shown in FIGS. 1 and 2, a vertical end post 16 is a rigid aluminum extrusion having a substantially rectangular cross section, and is attached at one side to a hinge member 14. The vertical end post 16 has a fastening device to lock the foldable closure to the side of the opening when the closure extends across the opening. Adjacent the hinge member 14 beside the vertical end post 16 is a half panel 18 which has a width substantially half that of the full panel 12. The half panel 18 allows the vertical end post 16 to be suspended from a central track and remain beneath the track when the panels are accordioned together so the closure is at one side of the opening.

Figure 4:
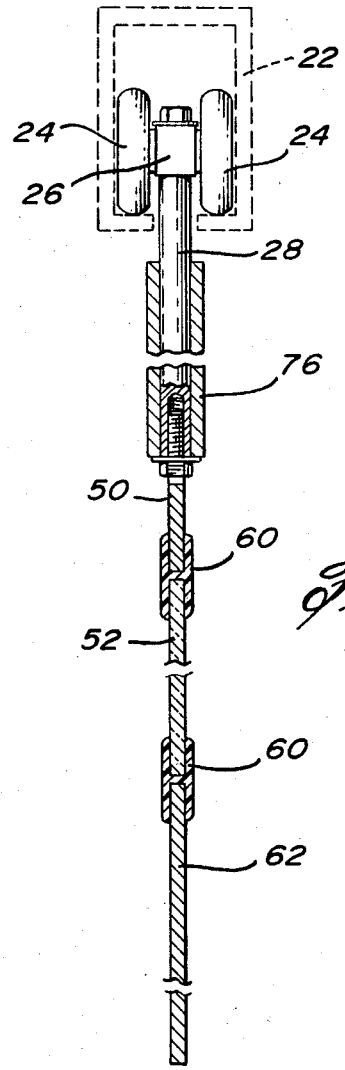
FIG. 4 is a sectional view taken at line 4—4 of FIG. 2.

As shown in FIG. 2, every second panel 12 has a support roller assembly 20 at the center of the panel 12. The support roller assembly rides in a top support track 22 as illustrated in FIG. 4 to support the closure 10. The top roller assembly 20 comprises two rollers 24 mounted on each side of a sliding block 26 which has limited vertical movement on a support rod 28. The limited vertical movement takes into account minor variations in the height of the track 22 above the floor of the opening. The sliding block 60 can also rotate on the support rod 28 to allow the panels to be folded together.

Figure 3:
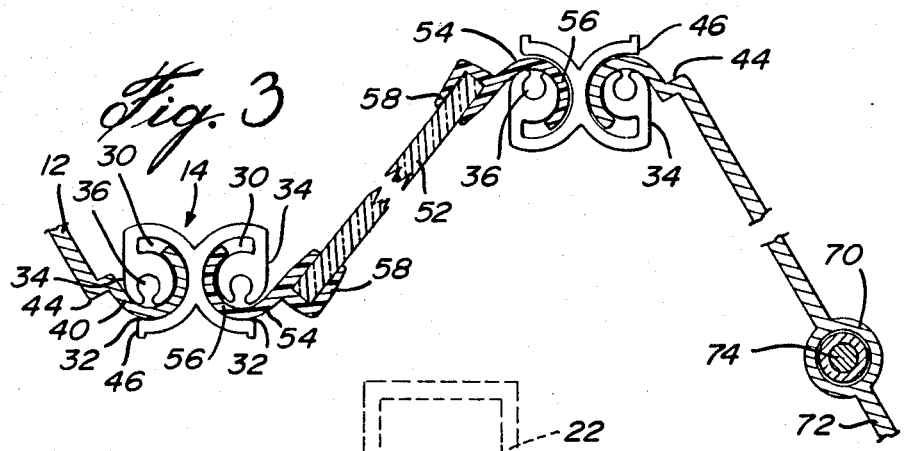
FIG. 3 is a sectional view taken at line 3—3 of FIG. 2.

The closure assembly 10 is only supported from above, therefore no track is necessary beneath the closure. By having only one roller support 20 for every two panels, friction from opening and closing the panels is kept down, and by supporting the closure assembly 10 from the center of every second panel, the closure 10 hangs evenly with its load evenly distributed on each side of the track 22. Details of the hinge member 14 and panels 12 are shown in FIG. 3 wherein the hinge member 14 is formed of an aluminum extrusion and has a cross section with two semi-circular grooves 30 within the extrusion, back to back to each other and having openings 32 opposite each other. A flat surface 34 is provided on each side of the hinge member 14 adjacent the openings 36 to act as a stop to prevent the sides of the panels 12 from pivoting out of the grooves 30. Each semi-circular groove 30 has a vertical axial aperture 36 which is positioned at the axis of the semi-circular groove 30 and is used to prevent the sides of the panels 12 from sliding out of the hinge member 14 by means of self tapping screw 38 which is screwed into the apertures 36. The self tapping screws 38 are shown in FIG. 2 and are provided at the top and the bottom of the hinge member 14. The self tapping screws 38 preferably have a hexagonal head with an integral washer or shoulder so that they extend to cover the area of the semi-circular groove 30 to hold the sides of the panels in the grooves.

The half panel 18 shown in FIGS. 1 and 2 is a one piece sheet with curved vertical sides 40. The curved vertical sides 40 are provided on the full panel 12 as well as the half panel 18, and extend for the full height of the panel or for strips forming the panel. If the panel is a one piece panel, then the curved vertical sides are at the top and bottom of the panel, but need not necessarily extend for the full height of the panel. The curved vertical side 40 on one side of the panel is on the opposite surface of the panel to the curved vertical side 40 on the side of the panel. The curved sides 40 slide into the semi-circular grooves 30 from one end and then after they are in place, locking screws 38 are fitted to the hinge member 14. A displacement step 44 is provided between the curved side 40 and the body of the panel to allow the panels to be folded together without the hinge members 14 interfering with adjacent panels. This displacement also permits the hinge members 14 and the center of the panels 12 to be substantially in line when the assembly is fully open or extended across the opening, yet the panels 12 themselves are at an angle of about 10° to the line and so when folded they will always fold in their proper direction and cannot become stuck in the open position or fold the incorrect way.

The displacement step 44 also acts as a stop and comes up against an edge 46 of the hinge member 14 adjacent the opening 32 when the closure assembly 10 is closed to fill the opening. Thus a combination of the displacement step 44 engaging with the edge 46 and the surface of the curved side 40 coming to rest against the flat surface 34 of the hinge member 14 permits each panel 12 to be rotated through an angle of about 90° relative to the hinge member 14 and have positive stops at the ends of the rotational movement. This is sufficient for the closure to be opened and closed when in the closed position, filling the opening, the panels are substantially in line with each other. When in the open position, leaving the opening open, the panels are folded or accordioned together, substantially parallel to each other.

The curved sides 40 of the panels 12 need not extend from top to bottom of the hinge member 14. As shown in FIGS. 2 and 4, one panel 12 has a top portion 50 which is a horizontal metal strip with an integral center sleeve for the support rod 28 of the support roller assembly 20. Beneath this horizontal strip 50 is a transparent sheet 52 which may be reinforced glass or clear plastic and has at each side, side plastic holders 54 which have curved sides 56 to fit in the semi-circular grooves 30 of the hinge members 14. The side plastic holders 54 have channel grooves 50 on the other side from the curved side 56. Top and bottom plastic holders 60 having an H-shaped cross section hold the transparent sheet 52 to the top horizontal strip 50 of the panel 12 and to a bottom horizontal strip 62 of the panel 12. The side plastic holders 54 hold the transparent sheet 52 in the same plane as the panel 12. The advantage of this unit is that by loosening the bottom screws 38 and disengaging the transparent sheet 52 from the plastic holders 60 at top and bottom, the transparent sheet can be removed without disassembling the panel 12. The side holder 54 can be rotated within the semi-circular groove 30 of the hinge member 14 so that the transparent sheet 52 is free of the holder 54 and the sheet 52 can be slid out of the panel 12. A new transparent sheet 52 can then be placed in position and the side holder 54 rotated in the semi-circular groove 30 so that the channel groove 58 slips over the edge of the transparent sheet 52. This is an advantage because it eliminates the need to remove the complete panel 12, take it apart, replace the transparent sheet and then reassemble and reinstall it.

Another advantage of this assembly is that the curved vertical sides 40 of the panel 12 do not extend for the full height of the panel 12 and therefore when the panel 12 is formed of an aluminum extrusion the friction of rotating the aluminum curved side 12 in the semi-circular groove 30 of an aluminum hinge member 14 is considerably reduced from when the hinge extends from top to bottom of the hinge member 14. The side plastic holder 54 being made of plastic is flexible and therefore there is little friction that occurs between this side holder 54 and the semi-circular groove 30 of the aluminum hinge member 14.

In another embodiment a top horizontal strip 50 is provided similar to that shown with a transparent panel, but having a tube 70 replacing the transparent sheet 52 to act as a spacer between a top horizontal strip 50 and a bottom horizontal strip 72. A bolt or rod 74 extends through a center sleeve 76 integral with the top and bottom horizontal strips 50 and 72 and also through tube 70. The center sleeve 76 is also used to hold the support rod 28 of the support roller assembly 20 at the top of every second panel 12. The rods 74 are supported at the top and bottom by self tapping screws 38 so they cannot move and a grill is formed through which no one can pass, thus the panel becomes a grill and in some circumstances, the whole assembly may be formed of open panels or grills for a closure in a shopping center or the like, which prevents access to a store, but is not to keep out weather or other environment.

Various changes may be made to the embodiments shown herein without departing from the scope of the present invention which is limited only by the following claims.

The embodiments of an invention in which an exclusive property or privilege is claimed are defined as follows:

1. A foldable closure assembly comprising:

a plurality of panels with adjacent panels joined by a one piece vertical hinge member, and top roller supports positioned at the center of every second panel for supporting the foldable closure assembly in a top support track, the one piece vertical hinge member extending from top to bottom of the panels and having a cross section with two semi-circular grooves with a single opening for each groove, the opening for each groove being on opposing sides of the hinge member, each of the semi-circular grooves in the hinge member having a vertical axial aperture at top and bottom for locking means (at top and bottom of the hinge member), the panels having portions, positioned at least at top and bottom of each of the panels, (the strips) with curved vertical sides to rotate in the semi-circular grooves of the hinge member through the openings, the curved vertical sides having stops to restrict rotation of each panel in the semi-circular grooves of the hinge member to about 90°.

2. The foldable closure assembly according to claim 1 wherein the portions in each of the semi-circular grooves are joined together to form a one piece sheet with curved vertical sides extending from top to bottom of the panel.

3. The foldable closure assembly according to claim 1 wherein the locking means at the top and bottom of the hinge member is a self tapping screw and integral washer fitting into each vertical axial aperture of the semi-circular grooves preventing the curved vertical sides of the panels from sliding out of the semi-circular grooves.

4. The foldable closure assembly according to claim 1 wherein at least one panel comprises a plurality of horizontal metal strips with curved vertical sides to rotate in the semi-circular grooves of the hinge member through the openings, and transparent sheets between the horizontal metal strips with top and bottom plastic holders to hold the transparent sheets to the horizontal metal strips, and side plastic holders to hold the transparent sheets, the side plastic holders having curved extension members to fit in the openings of the semi-circular grooves of the hinge member and allow rotation of the side plastic holders in the semi-circular grooves.

5. The foldable closure assembly according to claim 4 wherein the side plastic holders on one side of the panel may be rotated in the semi-circular grooves away from the transparent sheets so the transparent sheets may be removed.

6. The foldable closure assembly according to claim 1 wherein at least one panel comprises a plurality of horizontal metal strips with curved vertical sides to rotate in the semi-circular grooves of the hinge member through the openings, and vertical spacer tubes positioned in the center of the panel between the horizontal metal strips to form an open grill.

* * * * *

UNITED STATES PATENT AND TRADEMARK OFFICE

CERTIFICATE OF CORRECTION

PATENT NO. : 4,660,613

DATED : April 28, 1987

INVENTOR(S) : Robert Dagenais

It is certified that error appears in the above-identified patent and that said Letters Patent is hereby corrected as shown below:

In Claim 1, column 5, lines 14 and 15, delete "(at top and bottom of the hinge member)"; and, line 17, delete "(the strips)".

Signed and Sealed this

First Day of October, 1991

*Attest:*

HARRY F. MANBECK, JR.

*Attesting Officer*

*Commissioner of Patents and Trademarks*